US007261936B2

(12) United States Patent
Davis et al.

(10) Patent No.: US 7,261,936 B2
(45) Date of Patent: Aug. 28, 2007

(54) SYNTHETIC BLOWN INSULATION

(75) Inventors: Trent W. Davis, Mansfield, MA (US); Victor P. Laskorski, N. Attleborough, MA (US)

(73) Assignee: Albany International Corp., Albany, NY (US)

( * ) Notice: Subject to any disclaimer, the term of this patent is extended or adjusted under 35 U.S.C. 154(b) by 337 days.

(21) Appl. No.: 10/447,346

(22) Filed: May 28, 2003

(65) Prior Publication Data

US 2004/0241437 A1 Dec. 2, 2004

(51) Int. Cl.
*D04H 1/00* (2006.01)

(52) U.S. Cl. ..... 428/292.1; 428/90; 428/91; 428/370; 428/373; 428/392; 428/402.2

(58) Field of Classification Search ..... 428/373, 428/402.2, 398, 370, 212, 2, 90, 91, 4, 357, 428/360; 442/361; 403/266
See application file for complete search history.

(56) References Cited

U.S. PATENT DOCUMENTS

| | | | | |
|---|---|---|---|---|
| 988,010 | A | 3/1911 | Metzger | |
| 2,713,547 | A | 7/1955 | Frederick | 117/1 |
| 3,541,653 | A | 11/1970 | Stevenson | 28/77 |
| 3,892,909 | A | 7/1975 | Miller | 428/371 |
| 3,928,699 | A | 12/1975 | Fekete | 428/212 |
| 4,149,335 | A * | 4/1979 | Duescher | 43/42.53 |
| 4,205,926 | A * | 6/1980 | Carlson | 403/266 |
| 4,259,400 | A | 3/1981 | Bolliand | 428/288 |
| 4,418,103 | A * | 11/1983 | Tani et al. | 428/4 |
| 4,555,421 | A | 11/1985 | Yasue | 428/6 |
| 4,588,635 | A | 5/1986 | Donovan | 428/288 |
| 4,681,789 | A | 7/1987 | Donovan et al. | 428/93 |
| 4,882,217 | A | 11/1989 | FitzPatrick | 428/212 |
| 4,992,327 | A | 2/1991 | Donovan et al. | 428/296 |
| 5,057,168 | A * | 10/1991 | Muncrief | 156/62.6 |
| 5,194,121 | A | 3/1993 | Taguchi et al. | 162/358.1 |
| 5,476,711 | A * | 12/1995 | Hebbard et al. | 442/411 |
| 5,624,742 | A * | 4/1997 | Babbitt et al. | 428/212 |
| 5,776,312 | A | 7/1998 | Trokhan et al. | 162/358.2 |
| 5,851,665 | A | 12/1998 | Marcus | 428/357 |
| 5,869,180 | A | 2/1999 | Büdenbender et al. | 428/373 |
| 6,053,999 | A | 4/2000 | Marcus | |
| 6,200,669 | B1 | 3/2001 | Marmon et al. | 428/198 |
| 6,329,051 | B1 | 12/2001 | Groh et al. | 428/360 |
| 6,329,052 | B1 * | 12/2001 | Groh et al. | 428/360 |
| 6,589,652 | B2 * | 7/2003 | Groh et al. | 428/360 |
| 6,613,431 | B1 * | 9/2003 | Rumiesz et al. | 428/357 |

FOREIGN PATENT DOCUMENTS

| | | |
|---|---|---|
| DE | 1 560 796 A | 5/1970 |
| GB | PO3193 A | 7/1915 |
| JP | 57-056561 A | 4/1982 |
| JP | 5321186 A2 | 12/1993 |
| JP | 3187942 | 7/2001 |
| WO | WO99/32715 | 7/1999 |

* cited by examiner

*Primary Examiner*—B. Hamilton Hess
*Assistant Examiner*—David J. Joy
(74) *Attorney, Agent, or Firm*—Frommer Lawrence & Haug LLP; Ronald R. Santucci

(57) ABSTRACT

An insulation material having insulative properties of a synthetic down, while have a fir-tree structure more similar to natural down, and being in a blown form. The blowable insulation material is composed of plural units each having a number of filaments that are fused at one end of the unit and are open at an opposite end.

12 Claims, 3 Drawing Sheets

Example of natural 'down' structure

DUCK DOWN

Equal diameter filaments

Larger 'core' filament

SYNTHETIC BLOWN INSULATION

FIELD OF THE INVENTION

The present invention is directed towards an insulation material, particularly a material having a fir-tree structure similar to natural down whilst also being in a blowable form.

BACKGROUND OF THE INVENTION

There have been many attempts to achieve an insulating material having a down-like structure and qualities for use in insulating articles such as clothing, sleeping bags, comforters, and the like. Prior efforts to develop a feasible material have often yielded those with a structure dissimilar from real down, are too heavy and dense to be considered down-like, and/or are difficult to blow through conventional equipment.

These include the following by way of example:

U.S. Pat. No. 988,010 is a labor intensive means of producing a material described as simulating a feather. While twisting is used to achieve the divergence or "fanning" of the individual filaments, this patent teaches two separate components to make a "feather".

U.S. Pat. No. 2,713,547 uses chicken feathers or biers glued to a monofilament to produce a simulated down.

U.S. Pat. No. 3,541,653 is a means of producing high bulk yarns by sewing and slitting matts comprised of bulkable synthetic continuous filaments.

U.S. Pat. No. 3,892,919 describes a filling material using larger cylindrical or spherical formed fiber bodies along with feathery formed bodies which are mixed together with the latter relied upon to fill the voids.

U.S. Pat. No. 4,040,371 describes a polyester fiber filling material comprising a blend of polyester staple fibers with organic staple fibers.

U.S. Pat. No. 4,167,604 describes an improved thermal insulation material that is a blend of down and synthetic fiber staple formed from hollow polyester filaments which may be treated with silicone and formed into a carded web.

U.S. Pat. No. 4,248,927 describes an insulating material comprising a combination of natural feathers and downs, and synthetic polyesters formed into a web.

U.S. Pat. No. 4,259,400 provides a padding material that imitates natural feathers and consists of a flexible filiform textile rod on either side of which textiles fibers are bonded.

U.S. Pat. No. 4,468,336 describes loose fill insulation that is blown into spaces. The insulation material comprises a mixture of loose fill cellulosic insulation mixed with a staple fiber.

An exception to the aforementioned drawbacks is U.S. Pat. No. 4,588,635 which discloses a superior synthetic down and has particular reference to light-weight thermal insulation systems which can be achieved by the use of fine fibers in low density assemblies and describes a range of fiber mixtures, that, when used to fabricate an insulating batt, provides advantageous, down-like qualities such as a high warmth-to-weight ratio, a soft hand, and good compressional recovery. This material approaches, and in some cases might even exceed the thermal insulating properties of natural down. From a mechanical standpoint, the use of extremely fine fibers may result in concerns for rigidity and strength that make them difficult to produce, manipulate and use. Recovery properties of such a synthetic insulator material are enhanced at larger fiber diameters, but an increase in the large fiber component will seriously reduce the thermal insulating properties overall. The problems associated with mechanical stability of fine fiber assemblies are more of a concern in the wet condition since surface tension forces associated with the presence of capillary water are considerably greater than those due to gravitational forces or other normal use loading and they have a much more deleterious effect on the structure. However, unlike waterfowl down, the disclosed fiber combination does provide excellent resistance to wetting.

Another exception is U.S. Pat. No. 4,992,327 discloses the use of binder fiber components to improve insulator integrity without compromising desired attributes. More specifically the invention disclosed therein relates to synthetic fiber thermal insulator material in the form of a cohesive fiber structure, which structure comprises an assemblage of: (a) from 70 to 95 weight percent of synthetic polymeric microfibers having a diameter of from 3 to 12 microns; and (b) from 5 to 30 weight percent of synthetic polymeric macrofibers having a diameter of 12 to 50 microns, with at least some of the fibers are bonded at their contact points, the bonding being such that the density of the resultant structure is within the range 3 to 16 kg/m3. The thermal insulating properties of the bonded assemblage are equal to or not substantially less than the thermal insulating properties of a comparable unbonded assemblage. The reference also describes a down-like cluster form of the preferred fiber blends. The distinct performance advantages of the cluster form over the batt form are also disclosed in the patent.

U.S. Pat. No. 5,057,116 describes insulation formed by blending binder fibers with insulative fibers. The insulative fibers are selected from the group consisting of synthetic and natural fibers formed into a batt which may be cut into any desired shape.

U.S. Pat. No. 5,458,971 describes a fiber blend useful as a fiberfill in garments. The fiberfill blend comprises crimped hollow polyester fiber and crimped binder fibers.

U.S. Pat. No. 5,492,580 describes a material formed by blending a mix of first thermoplastic, thermoset, inorganic, or organic fibers with second thermoplastic fibers.

U.S. Pat. No. 5,624,742 describes a blowing insulation that comprises a blend of first and second insulating (glass) fiber materials. One of the groups of fibers is smaller in size for filling the voids between the fibers of the larger group.

However, prior art clusters often are generally hand fabricated in a slow, tedious, batch process. Furthermore, some of the prior art materials are not easily blowable materials which can be used with conventional manufacturing equipment.

It should also be noted that prior art insulation material may take various forms such as staple fibers of various sizes, hollow and solid fibers, and crimped fibers, among others. Various shapes have also been suggested such as spheres (U.S. Pat. No. 4,065,599), spheres with projecting fibers to allow for interlocking (U.S. Pat. No. 4,820,574), crimped bundles of fibers (U.S. Pat. No. 4,418,103), assemblies of looped fibers (U.S. Pat. No. 4,555,421), rolls of fibers, bails, bundles and pin cushion configurations (U.S. Pat. No. 3,892,909), just to mention a few.

In addition, clusters of fibers formed from shredded batt, such as that disclosed in U.S. Pat. No. 6,329,051 entitled "Blowable Insulation Clusters", and such clusters in an admixture with natural fibers such as down, as disclosed in U.S. Pat. No. 6,329,052 entitled "Blowable Insulation", have been found particularly suitable as insulation/fill material.

Various ways of creating an alternative but related form of insulation include fiber fill or fiber balls. Other forms of synthetic alternatives to natural insulation include that disclosed in U.S. Pat. No. 5,851,665 which describes point bonding of tows of fibers. Another way, as disclosed in U.S. Pat. No. 5,218,740 is to feed a uniform layer of staple fiber into a rotating cylinder covered with card clothing and rolling the fiber into rounded clusters which are removed by a special doffer screen. Others suggest blowing or air tumbling the fiber into a ball. (See e.g. U.S. Pat. Nos. 4,618,531; 4,783,364; and 4,164,534.)

While some or all of the foregoing references have certain attendant advantages, further improvements and/or alternative forms, is always desirable.

SUMMARY OF THE INVENTION

It is therefore a principal object of the invention to provide for an insulation material which has a superior thermal, loft, comfort and water absorption characteristics exhibited by some of the aforesaid references, however, through the use of a fir-tree structure more similar to natural down whilst being in a blowable form.

It is a further object of the invention to provide for an insulation material that is a substitute for natural down at a lower cost.

A further object of the invention is to provide for a cohesive insulation material in which bonding of filaments reduces the fiber poke-through of covering fabrics.

A still further object of the invention is to provide for a method for producing such an insulation material which offers wide flexibility to vary the specification and properties of the resultant materials.

A still further object of the invention is to provide such a method that can be applied to a wide range of thermoplastic materials.

These and other objects and advantages are provided by the present invention. In this regard, the present invention is directed towards a synthetic down insulation material. The material is similar to a product sold under the trademark Primaloft® which is owned by Albany International Corp. The material is comprised of a large number of dendritic structures, each having a number of individual fibers or filaments joined or fused at one end and free at the opposite end. This yields a "fir-tree" like structure similar to the structure of natural down. Moreover, variations of the exact structure are numerous and include, however, all filaments of equal diameter, all filaments of the same material, a blend of different materials and filament diameters, a larger diameter core fiber with smaller diameter filaments surrounding it, straight filaments and crimped filaments, all of which allows for a variation of the resulting properties of the insulation to meet the desired needs.

A methodology for the production of the inventive material is also described herein. First, a multi-filament yarn in a continuous form is produced. The filaments of the yarn may be twisted, braided, or twisted about a core filament. Second, the yarn is fed through a device at high speed where it is intermittently fused together by the application of a high energy, low dwell time heat source and then cut into desired lengths.

BRIEF DESCRIPTION OF THE DRAWINGS

Thus by the present invention, its objects and advantages will be realized the description of which should be taken in conjunction with the drawings wherein.

DETAILED DESCRIPTION OF THE PREFERRED EMBODIMENTS

Figure 1:
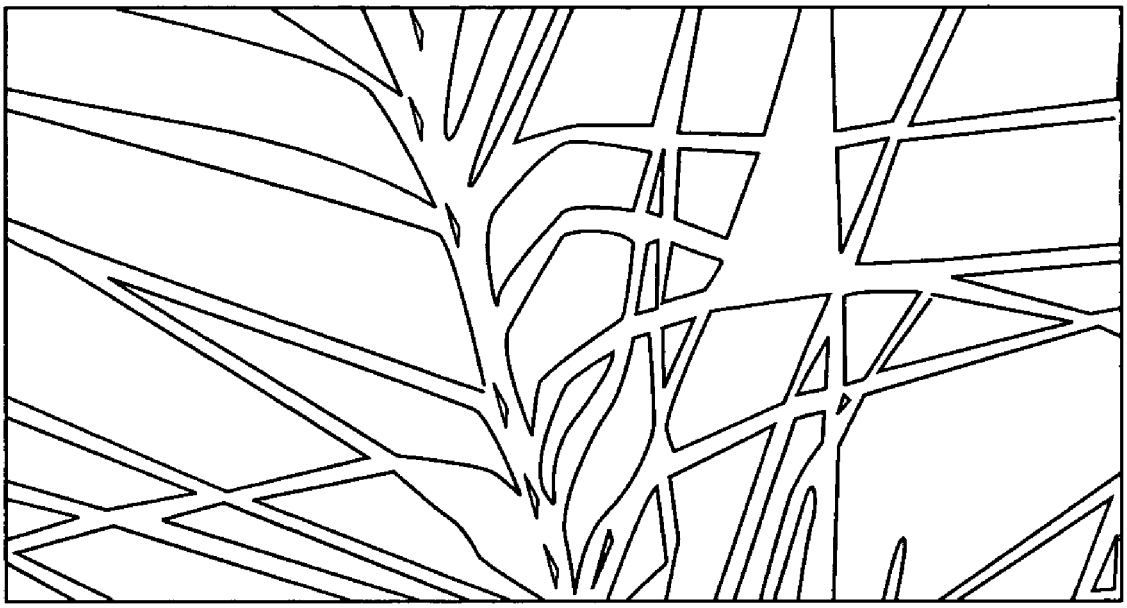
FIG. 1 is a side sectional view of the an example of a natural down structure.
Figure 2A:
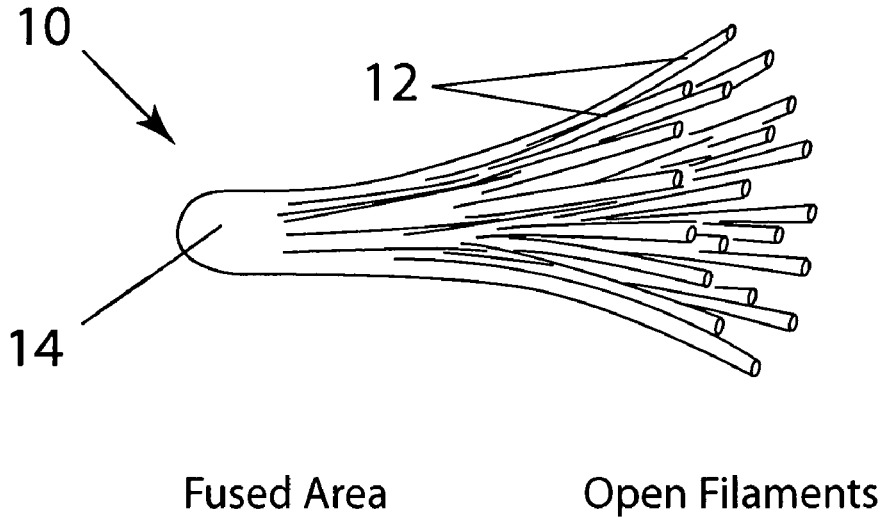
FIGS. 2A-2B are side views of an insulation material in a blown form having a fused end and a group of open filaments, incorporating the teachings of the present invention.

Turning now more particularly to the drawings, FIG. 2A shows generally the insulation material of the present invention which is in a blowable form. The insulation structure 10 comprises a number of individual filaments 12 joined or fused at one end 14 and open at the opposite end. That is, the insulation structure 10 comprises a fir-tree like or dendritic structure, similar to the structure of the natural down fiber shown in FIG. 1.

Figure 2B:
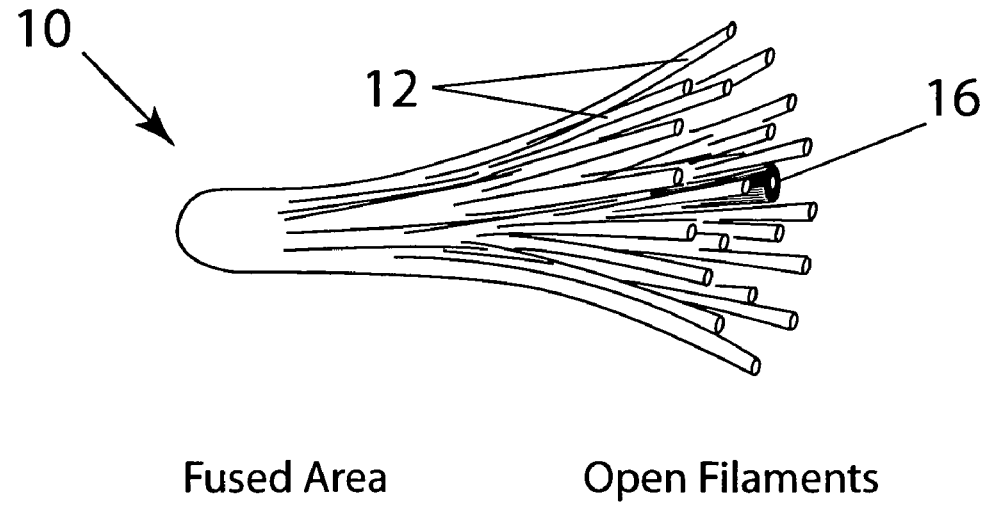

In this connection, the insulation structure 10 may have all filaments 12 of equal diameter as shown in FIG. 2A, or alternatively, a larger diameter core filament 16 surrounded by a plurality of open filaments 12 of smaller diameter as shown in FIG. 2B. In addition, the number and length of the filaments 12, 16 may be varied. Also, the insulation structure 10 may have straight filaments as shown in FIGS. 2A and 2B, or alternatively, crimped filaments (not shown).

The insulation structure 10 may comprise a wide range of thermoplastic materials suitable for the purpose and well known to the skilled artisan, although the inclusion of non-thermoplastics is also envisaged. Additionally, insulation structure 10 may comprise all filaments 12, 16 of the same material, or, alternatively, a blend of different materials to give, for example, a broader range of properties. Finally, the filaments 12, 16 can be treated for water repellency using, for example, silicone.

Figure 3:
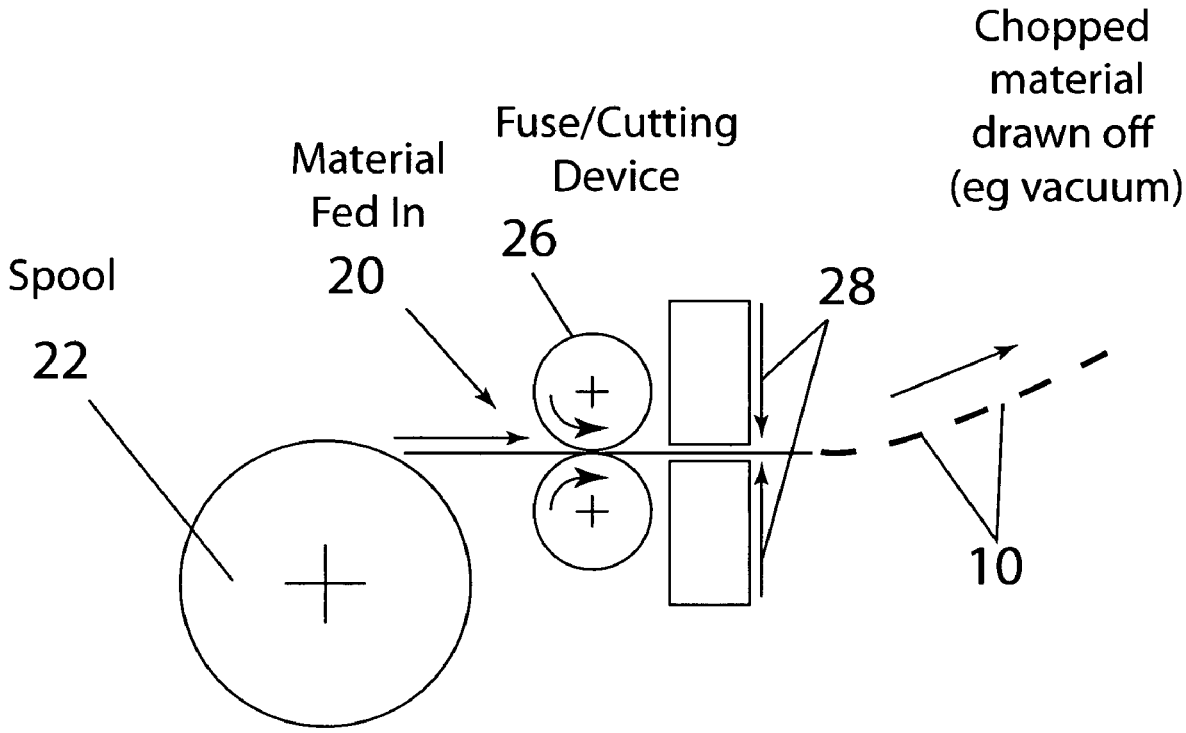
FIG. 3 is a side view depicting a method and device for the manufacture of the insulation material, incorporating the teachings of the present invention.

The present invention is also directed towards a method for producing the insulation structures 10 as shown in FIG. 3. The first step of the method is to produce a multifilament yarn 20 comprising the constituent materials in a continuous form. This precursor material 20 may be produced in a number of ways (not shown), including one of simple twisting of multiple component filaments together, braiding, twisting over a core filament, or other technique suitable for the purpose. The thus produced material 20 can then be stored on a spool 22 in preparation for use in step two as follows.

The second step of the method is to feed the precursor material 20 at high speed through rollers 26 and into a device 24 which performs two functions. In device 24, the material 20 is first, intermittently fused together, and secondly, but almost simultaneously, cut into the desired lengths. The resultant insulation structures 10 are thereafter drawn off using air-flow, vacuum, electrostatics, mechanical means, or other means suitable for the purpose.

In connection with fusing/cutting device 24, the material 20 may be fused using a high energy, low dwell time heat source, such as coincident laser beams 28, which obtain high temperatures in a very short time, and can be easily controlled. Laser beams 28 may be used to both fuse and cut the material 20. This may be performed by either varying the energy or time delay so as to initially fuse but subsequently vaporize the material 20, thereby yielding the desired length. Alternatively, the material 20 may also be cut mechanically at high speeds to coincide with the fused sections (not shown).

Where the precursor material 20 is originally formed by the above-described twisting, it is noted that the subsequent cutting process will release the restraining torque on the multifilaments and ensure the divergence, or fanning, of the resultant filaments 12, 16 shown in FIGS. 2A and 2B. This fanning is important in order for the insulation material to function properly. Additionally, electrostatic effects can be used to further promote the fanning of the individual filaments 12, 16. In this connection, twist angle variation may give rise to greater or lesser degree of filament 12, 16 separation as required.

Thus by the present invention its objects and advantages are realized, and although preferred embodiments have been disclosed and described in detail herein, its scope and objects should not be limited thereby; rather its scope should be determined by that of the appended claims.

What is claimed is:

1. A blowable insulation material comprising a plurality of units, each unit having a conically fanned out configuration formed of a plurality of filaments that are fused at one end of the unit and are open at an opposite end.

2. The material in accordance with claim 1, wherein all the filaments are of equal diameter.

3. The material in accordance with claim 1, wherein the unit has a larger diameter core filament surrounded with filaments of smaller diameter.

4. The material in accordance with claim 1, wherein the filaments are straight.

5. The material in accordance with claim 1, wherein the filaments are crimped.

6. The material in accordance with claim 1, wherein the units comprise thermoplastics.

7. The material in accordance with claim 1, wherein the units comprise non-thermoplastics.

8. The material in accordance with claim 1, wherein the units comprise all the same material.

9. The material in accordance with claim 1, wherein the units comprise a blend of different materials.

10. The material in accordance with claim 9, wherein the blend of different materials yields a broader range of properties.

11. The material in accordance with claim 1, wherein the length of the filaments is varied.

12. The material in accordance with claim 1, wherein the filaments are treated for water repellency.

* * * * *